US010964504B2

(12) United States Patent
Shimoda et al.

(10) Patent No.: US 10,964,504 B2
(45) Date of Patent: Mar. 30, 2021

(54) RELAY

(71) Applicant: OMRON CORPORATION, Kyoto (JP)

(72) Inventors: Seiki Shimoda, Yamaga (JP); Yuichiro Teshima, Yamaga (JP); Akira Tsurusaki, Kumamoto (JP)

(73) Assignee: OMRON Corporation, Kyoto (JP)

( * ) Notice: Subject to any disclaimer, the term of this patent is extended or adjusted under 35 U.S.C. 154(b) by 491 days.

(21) Appl. No.: 15/754,612

(22) PCT Filed: Nov. 16, 2016

(86) PCT No.: PCT/JP2016/083973
§ 371 (c)(1),
(2) Date: Feb. 23, 2018

(87) PCT Pub. No.: WO2017/098873
PCT Pub. Date: Jun. 15, 2017

(65) Prior Publication Data

US 2020/0227224 A1 Jul. 16, 2020

(30) Foreign Application Priority Data

Dec. 11, 2015 (JP) ..... JP2015-242408

(51) Int. Cl.
*H01H 50/64* (2006.01)
*H01H 50/32* (2006.01)
(Continued)

(52) U.S. Cl.
CPC ..... *H01H 50/643* (2013.01); *H01H 50/14* (2013.01); *H01H 50/32* (2013.01); *H01H 50/56* (2013.01); *H01H 50/62* (2013.01)

(58) Field of Classification Search
CPC ..... H01H 50/643; H01H 50/14; H01H 50/32; H01H 50/56; H01H 50/62; H01H 50/20; H01H 50/642; H01H 51/084; H01H 50/64
See application file for complete search history.

(56) References Cited

U.S. PATENT DOCUMENTS 1,339,922 A 5/1920 Deutsch
1,354,708 A 10/1920 Whittingham
(Continued)

FOREIGN PATENT DOCUMENTS

CN 201766036 U 3/2011
CN 102237207 A 11/2011
(Continued)

OTHER PUBLICATIONS

Indian Office Action dated Nov. 14, 2019 in a counterpart Indian patent application.
(Continued)

*Primary Examiner* — Mohamad A Musleh
(74) *Attorney, Agent, or Firm* — Metrolex IP Law Group, PLLC

(57) ABSTRACT

The movable body includes a pivot and a contact portion. The pivot is rotatably supported. The contact portion is disposed at a position contactable with a contact piece. The movable body rotates around the pivot and presses the contact piece via the contact portion to move the second contact close to the first contact. The actuator presses the movable body to rotate the movable body around the pivot. The contact piece has a curved portion located between the second contact and the support. The pivot is located on a side where the support is disposed with respect to the curved portion. The actuator includes a pressing member which presses the movable body. The pressing member moves in
(Continued)

an axial direction of the pressing member to press the movable body.

12 Claims, 17 Drawing Sheets

(51) Int. Cl.
*H01H 50/62* (2006.01)
*H01H 50/14* (2006.01)
*H01H 50/56* (2006.01)

(56) References Cited

U.S. PATENT DOCUMENTS

| | | | | |
|---|---|---|---|---|
| 1,369,934 | A | 3/1921 | Onstad | |
| 2,005,195 | A | 6/1935 | Mccabe | |
| 2,157,844 | A | 5/1939 | Armstrong | |
| 2,654,009 | A | 9/1953 | Tremblay | |
| 2,663,774 | A | 12/1953 | Macneill | |
| 2,821,666 | A * | 1/1958 | Austin | H01H 50/20 361/20 |
| 2,833,885 | A * | 5/1958 | Wells | H01H 50/56 335/129 |
| 2,959,962 | A | 11/1960 | Epstein | |
| 3,098,912 | A | 7/1963 | Sprague | |
| 3,234,344 | A | 2/1966 | Heilman | |
| 3,268,043 | A | 8/1966 | Murdoch | |
| 3,272,934 | A | 9/1966 | Schwartz | |
| 3,307,125 | A | 2/1967 | Schwarzkopf | |
| 3,344,372 | A | 9/1967 | Heilman | |
| 3,363,571 | A | 1/1968 | Reynolds | |
| 3,414,849 | A * | 12/1968 | Burt, Jr. | H01P 1/125 333/105 |
| 3,517,357 | A | 6/1970 | Bakes | |
| 3,566,320 | A | 2/1971 | Bakes | |
| 3,773,992 | A | 11/1973 | Mune | |
| 3,788,597 | A | 1/1974 | Ichioka | |
| 3,791,408 | A | 2/1974 | Saitou et al. | |
| 4,267,539 | A | 5/1981 | Guinan | |
| 4,316,167 | A | 2/1982 | Koehler | |
| 4,515,343 | A | 5/1985 | Pischinger et al. | |
| 4,540,965 | A | 9/1985 | Hattori et al. | |
| 4,683,453 | A | 7/1987 | Vollmer et al. | |
| 5,072,328 | A * | 12/1991 | Dvorak | H01H 50/323 361/210 |
| 5,207,410 | A | 5/1993 | Wakeman | |
| 5,389,910 | A | 2/1995 | Abel | |
| 5,845,672 | A | 12/1998 | Reuter et al. | |
| 6,044,813 | A | 4/2000 | Bulgatz et al. | |
| 6,049,264 | A | 4/2000 | Sailer et al. | |
| 6,084,492 | A | 7/2000 | Cereda et al. | |
| 6,092,784 | A | 7/2000 | Kalfsbeck | |
| 6,125,803 | A | 10/2000 | Hattori et al. | |
| 6,155,503 | A | 12/2000 | Benson et al. | |
| 6,157,277 | A | 12/2000 | Bulgatz et al. | |
| 6,373,361 | B1 | 4/2002 | Umemoto et al. | |
| 6,373,363 | B1 | 4/2002 | Spakowski et al. | |
| 6,414,406 | B1 | 7/2002 | Ikoma et al. | |
| 6,420,949 | B1 | 7/2002 | Umemoto et al. | |
| 6,677,844 | B1 | 1/2004 | Gorospe et al. | |
| 8,136,790 | B2 | 3/2012 | Hoppe et al. | |
| 8,350,652 | B2 | 1/2013 | Hoppe et al. | |
| 9,502,167 | B1 | 11/2016 | Gieras | |
| 2001/0003277 | A1 | 6/2001 | Oyama et al. | |
| 2001/0040018 | A1 | 11/2001 | Bulgatz | |
| 2002/0057154 | A1 | 5/2002 | Keck | |
| 2002/0066176 | A1 | 6/2002 | Paasch et al. | |
| 2004/0025949 | A1 | 2/2004 | Wygnaski | |
| 2004/0257185 | A1 | 12/2004 | Telep | |
| 2005/0189021 | A1 | 9/2005 | Wygnanski | |
| 2006/0049901 | A1 | 3/2006 | Bottcher et al. | |
| 2007/0062591 | A1 | 3/2007 | Armour | |
| 2007/0171009 | A1 | 7/2007 | Bouchard et al. | |
| 2007/0171016 | A1 | 7/2007 | Bonjean et al. | |
| 2008/0129432 | A1 | 6/2008 | Buezis et al. | |
| 2009/0001302 | A1 | 1/2009 | Murayama | |
| 2010/0186719 | A1 | 7/2010 | Venkataraghavan et al. | |
| 2010/0294221 | A1 | 11/2010 | Talon et al. | |
| 2011/0253918 | A1 | 10/2011 | Rampen et al. | |
| 2011/0285484 | A1 | 11/2011 | Hoppe et al. | |
| 2012/0153199 | A1 | 6/2012 | Nguyen | |
| 2012/0154077 | A1 | 6/2012 | Mikl | |
| 2012/0268225 | A1 | 10/2012 | Mahajan et al. | |
| 2015/0002248 | A1 | 1/2015 | Iwamoto | |
| 2015/0318135 | A1 | 11/2015 | Schuster et al. | |
| 2015/0340144 | A1 | 11/2015 | Schmitz et al. | |
| 2016/0020042 | A1 | 1/2016 | Stanton et al. | |
| 2017/0175919 | A1 | 6/2017 | Robertson | |
| 2017/0284556 | A1 | 10/2017 | Omekanda et al. | |
| 2018/0233260 | A1 | 8/2018 | Franz et al. | |
| 2019/0121120 | A1 | 4/2019 | Schiepp et al. | |
| 2019/0148045 | A1 | 5/2019 | Tsuzuki et al. | |

FOREIGN PATENT DOCUMENTS

| | | | |
|---|---|---|---|
| CN | 102568937 | A | 7/2012 |
| CN | 202423142 | U | 9/2012 |
| CN | 203013634 | U | 6/2013 |
| CN | 203205353 | U | 9/2013 |
| CN | 204668248 | U | 9/2015 |
| EP | 3089190 | A1 | 11/2016 |
| GB | 2511569 | B | 5/2015 |
| JP | S47-4698 | B1 | 2/1972 |
| JP | S63-18182 | A | 1/1988 |
| JP | S64-31315 | A | 2/1989 |
| JP | H11-273533 | A | 10/1999 |
| JP | 2002-343215 | A | 11/2002 |
| JP | 2012-74138 | A | 4/2012 |
| JP | 2012-129206 | A | 7/2012 |
| JP | 2015-88463 | A | 5/2015 |
| JP | 5741679 | B1 | 7/2015 |
| WO | 2015/098171 | A1 | 7/2015 |
| WO | 2016/039220 | A1 | 3/2016 |

OTHER PUBLICATIONS

Chinese Office Action (CNOA) dated May 17, 2019 in a counterpart Chinese patent application.
English translation of the International Search Report of PCT/JP2016/083973 dated Feb. 7, 2017.
English translation of the Written Opinion of PCT/JP2018/083973 dated Feb. 7, 2017.
English translation of the International Search Report of PCT/JP2016/083974 dated Feb. 7, 2017.
English translation of the Written Opinion of PCT/JP2018/083974 dated Feb. 7, 2017.
Chinese Office Action (CNOA) dated Dec. 10, 2018 in a counterpart Chinese Patent application.
Indian Office Action dated Nov. 21, 2019 in a related Indian patent application.
Chinese Office Action (CNOA) dated Oct. 31, 2018 in a related Chinese Patent application.
U.S. Office Action dated Mar. 20, 2020 in a related U.S. Appl. No. 15/754,772.

* cited by examiner

RELAY

TECHNICAL FIELD

The present invention relates to a relay.

BACKGROUND ART

There is known a relay which presses a contact piece by rotation of a movable body to bring contacts into contact with each other. For example, a relay disclosed in Patent Document 1 includes a movable block functioning as a movable body. The movable block is disposed between a pair of yokes connected to a coil. The movable block includes a movable iron piece. The movable block rotates when the movable iron piece is attracted by magnetic force generated by the coil. The movable block includes an arm, which is connected to a contact piece via a card. The arm moves the card in accordance with rotation of the movable block. The moved card presses the contact piece to bring a movable contact and a fixed contact into contact with each other.

PRIOR ART DOCUMENT

Patent Document

Patent Document 1: Japanese Patent No. 5741679

SUMMARY OF THE INVENTION

Problems to be Solved by the Invention

According to the relay mentioned above, the movable block moves the card while resisting elastic force of the contact piece. Accordingly, the movable block receives a load generated by the elastic force of the contact piece during rotation of the movable block. When the load applied to the movable block increases, force required for rotating the movable block increases accordingly. As a result, a problem of an increase in power consumption by the coil may arise.

An object of the present invention is to provide a relay which includes contacts operable with small force to reduce energy consumed by an actuator.

Means for Solving the Problem

A relay according to an aspect of the present invention includes a first contact, a second contact, a contact piece, a support, a movable body, and an actuator. The second contact is disposed at a position facing the first contact. The second contact is attached to the contact piece. The support supports the contact piece. The movable body includes a pivot and a contact portion. The pivot is rotatably supported. The contact portion is disposed at a position contactable with the contact piece. The movable body rotates around the pivot and presses the contact piece via the contact portion to move the second contact close to the first contact. The actuator presses the movable body to rotate the movable body around the pivot. The contact piece has a curved portion located between the second contact and the support. The pivot is located on a side where the support is disposed with respect to the curved portion. The actuator includes a pressing member which presses the movable body. The pressing member moves in an axial direction of the pressing member to press the movable body.

In the relay according to the aspect, a long distance is secured between the pivot and the contact portion by positioning the pivot on the side where the support is disposed with respect to the curved portion. Moreover, a long distance is secured between the pivot and a pressing position at which the pressing member presses the movable body by positioning the pivot on the side where the support is disposed with respect to the curved portion. Thus, the second contact is movable with small pressing force generated by the actuator. Accordingly, energy consumed by the actuator can be reduced.

A pressing position at which the actuator presses the movable body may be located between the pivot and the contact portion. In this case, the second contact is largely movable with a small stroke of the actuator.

The pressing position may be located on a side where the second contact is disposed with respect to the curved portion. In this case, force required by the actuator for moving the movable body can be further reduced.

The pressing position may be located on a side where the curved portion is disposed with respect to the second contact. In this case, a stroke of the actuator required for moving the second contact can be reduced.

The movable body may have a bent shape. In this case, the movable body, the actuator, and the contact piece can be disposed in a compact manner even when the movable body is elongated.

The movable body may include a first movable portion and a second movable portion. The first movable portion may include the pivot, and extend in a lengthwise direction of the contact piece. The second movable portion may include the contact portion, and extend from the first movable portion toward the contact piece. In this case, the contact portion can be brought into stable contact with the contact piece.

The first movable portion and the second movable portion may be separate portions. In this case, the second movable portion can move in a direction different from a rotation direction of the first movable portion. For example, the first movable portion can rotate around the pivot, while the second movable portion can move in parallel with the moving direction of the second contact.

The first movable portion and the second movable portion may be integrated into one piece. In this case, the contact piece can be pressed in such a manner as to immobilize the second contact by rotational movement of the second movable portion along with the first movable portion.

A leading end portion of the contact piece may have a shape bent toward the contact portion. In this case, the contact portion can be brought into stable contact with the contact piece.

A leading end of the pressing member may have a curved shape. In this case, abrasion of the pressing member produced by friction with the movable body can be reduced.

The pressing member may be configured to move in the axial direction of the pressing member and rotate around the axis. The leading end of the pressing member may have a spherical shape. In this case, abrasion of the pressing member produced by friction with the movable body can be reduced.

The pressing member may be configured to move to an off-position where the first contact and the second contact are not in contact with each other, and an on-position where the first contact and the second contact are in contact with each other. The actuator may further include a retaining member that latches the pressing member to retain the pressing member at the on-position. In this case, the pressing member can be stably retained at the on-position without being affected by impact or magnetic force from the outside, compared to the case where the pressing member is retained at the on-position by magnetic force.

Effect of the Invention

According to the present invention, a relay which includes contacts operable with small force to reduce energy consumed by an actuator can be provided.

MODE FOR CARRYING OUT THE INVENTION

Figure 1:
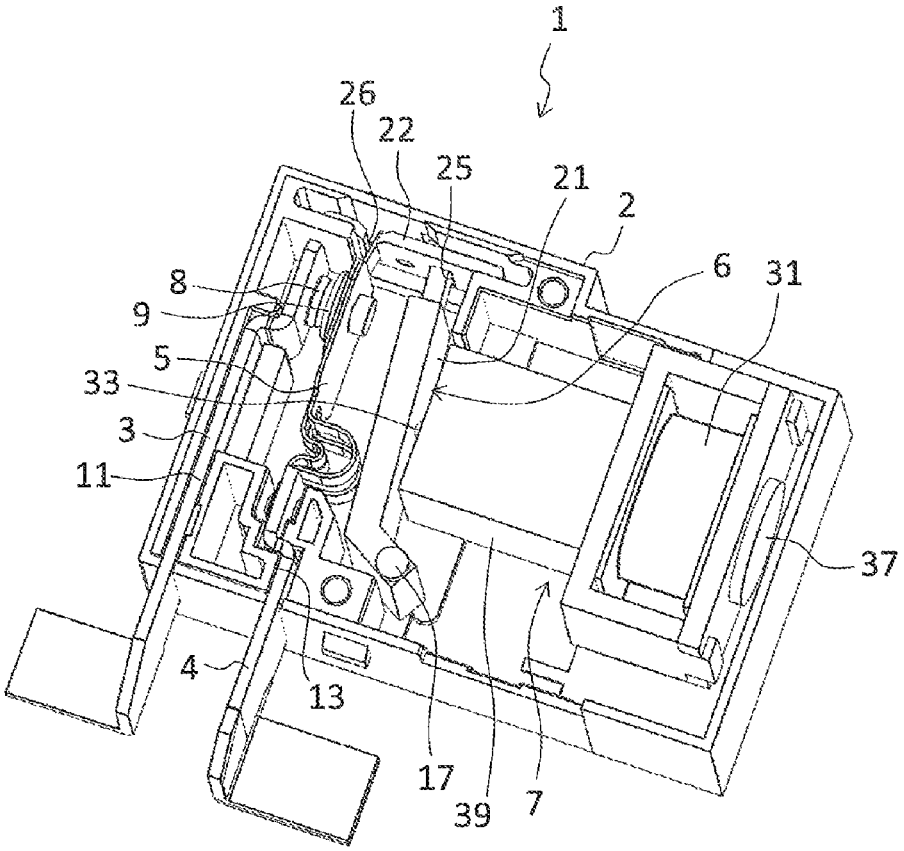
FIG. 1 is a perspective view of a relay according to an embodiment.
Figure 2:
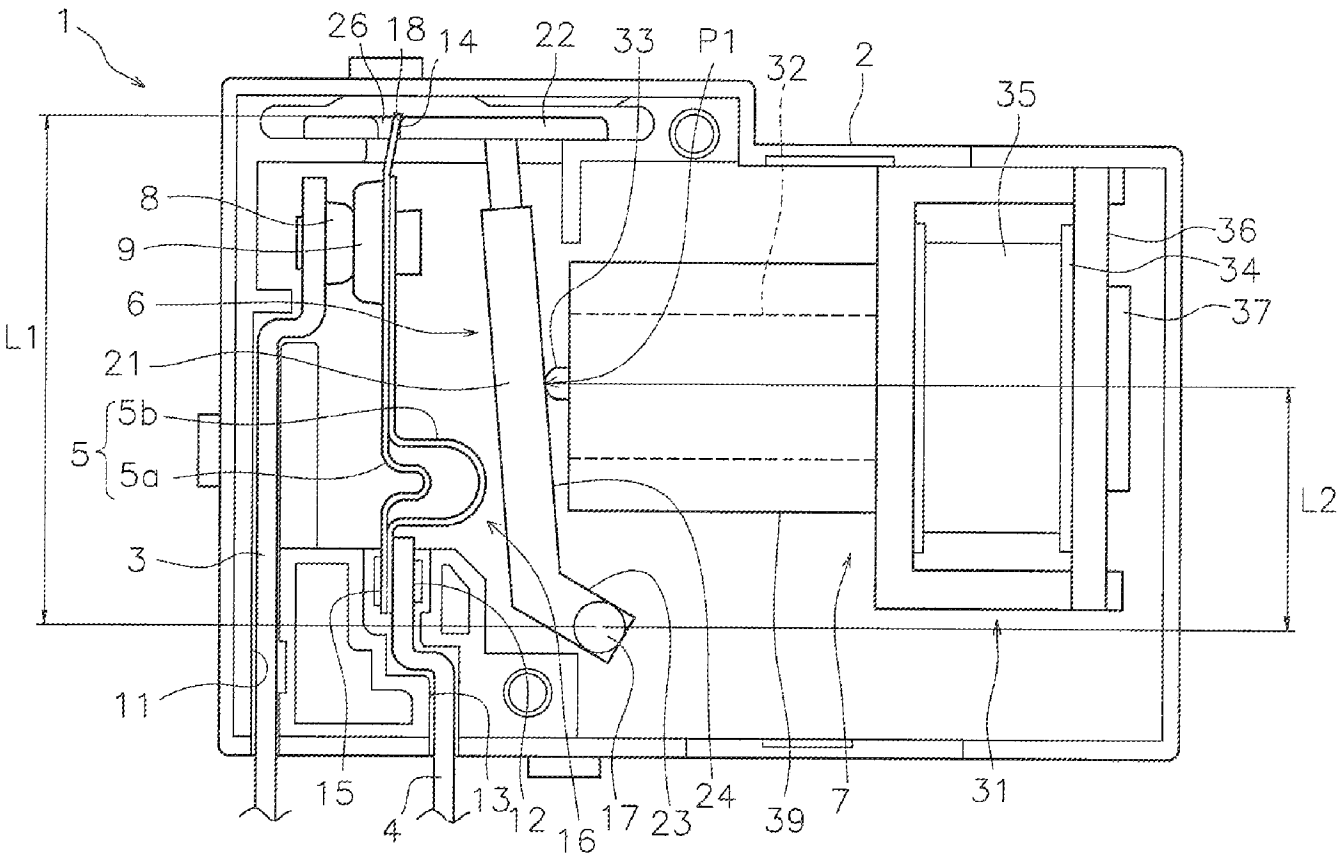
FIG. 2 is a plan view of the relay in a set state.
Figure 3:
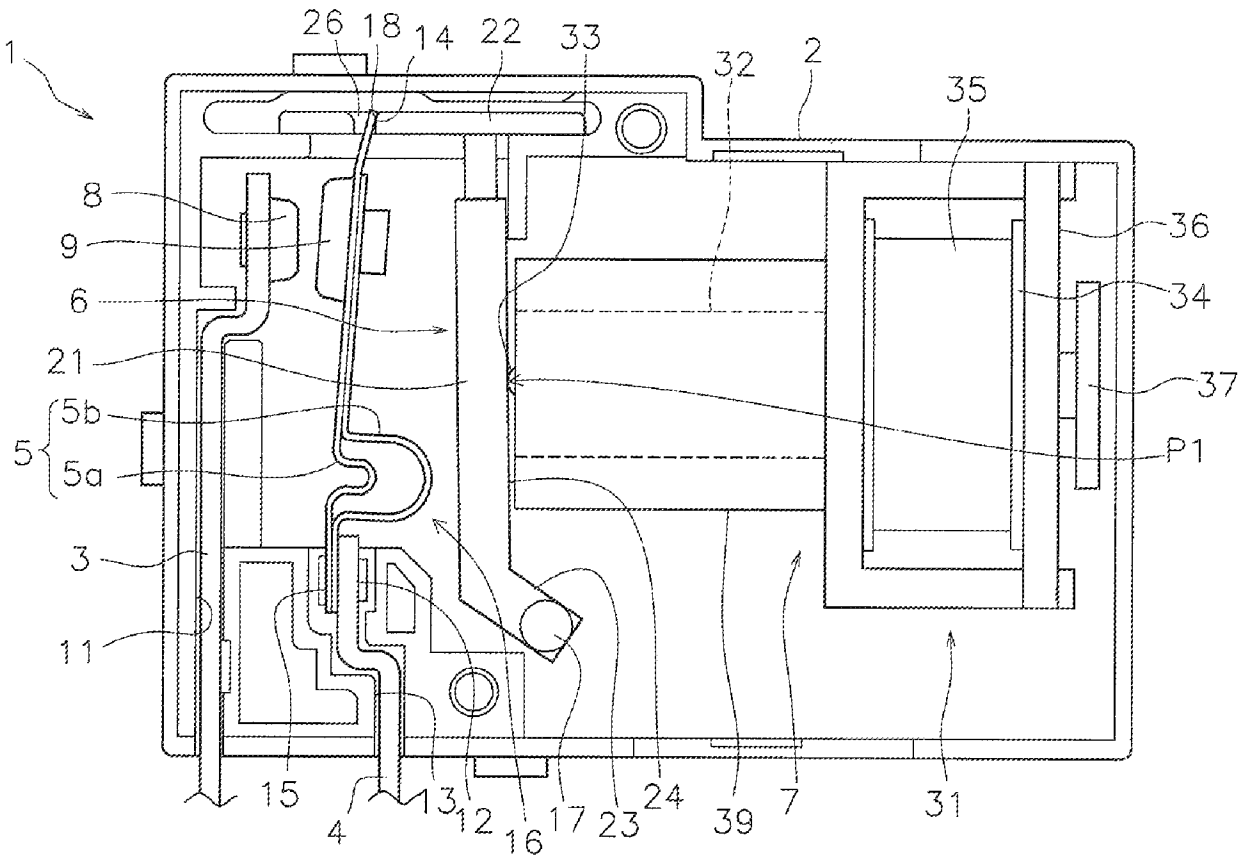
FIG. 3 is a plan view of the relay in a reset state.

A relay according to an embodiment is hereinafter described with reference to the drawings. FIG. 1 is a perspective view of a relay 1 according to the embodiment. FIGS. 2 and 3 are plan views of the relay 1. FIG. 2 illustrates the relay 1 in a set state, while FIG. 3 illustrates the relay 1 in a reset state. The relay 1 according to the embodiment is a latching relay. As illustrated in FIGS. 1 to 3, the relay 1 includes a base 2, a fixed contact terminal 3, a movable contact terminal 4, a contact piece 5, a movable body 6, and an actuator 7.

The base 2 houses the fixed contact terminal 3, the movable contact terminal 4, the contact piece 5, and the actuator 7. The base 2 has an opened face. The opening of the base 2 is covered by a not-shown cover.

The fixed contact terminal 3 is made of a conductive material such as copper. A first contact 8 is attached to one end of the fixed contact terminal 3. The other end of the fixed contact terminal 3 projects from the base 2 toward the outside. A first support groove 11 is formed inside the base 2. The fixed contact terminal 3 is fitted into the first support groove 11 to be supported on the base 2.

The movable contact terminal 4 is made of a conductive material such as copper. As illustrated in FIG. 2, a support 12 is provided at one end of the movable contact terminal 4. The contact piece 5 is attached to the support 12. The other end of the movable contact terminal 4 projects from the base 2 toward the outside. A second support groove 13 is formed inside the base 2. The movable contact terminal 4 is fitted into the second support groove 13 to be supported on the base 2.

The contact piece 5 is made of a conductive material such as copper. The contact piece 5 is disposed at a position facing the fixed contact terminal 3. A leading end portion 14 of the contact piece 5 is pressed by the movable body 6. A proximal end portion 15 of the contact piece 5 is attached to the support 12 of the movable contact terminal 4. The contact piece 5 is supported on the support 12. A second contact 9 is attached to the contact piece 5. The second contact 9 is disposed at a position facing the first contact 8. The second contact 9 is located between the leading end portion 14 and the support 12.

The contact piece 5 includes a curved portion 16. The curved portion 16 is located between the second contact 9 and the support 12. The second contact 9 is located between the leading end portion 14 and the curved portion 16. The curved portion 16 has a shape expanded in a direction away from the fixed contact terminal 3. The curved portion 16 may have a shape expanded in a direction toward the fixed contact terminal 3. The contact piece 5 includes a plurality of leaf springs 5*a* and 5*b*. The contact piece 5 is constituted by a lamination of the plurality of leaf springs 5*a* and 5*b*.

The second contact 9 is provided to be movable relative to the first contact 8. More specifically, the contact piece 5 is pressed by the movable body 6 to thereby elastically deform and bend toward the fixed contact terminal 3. The second contact 9 thus moves toward the first contact 8. When the press against the contact piece 5 by the movable body 6 is released, the contact piece 5 returns in a direction away from the fixed contact terminal 3 by elastic force of the contact piece 5. The second contact 9 thus moves away from the first contact 8. Alternatively, the contact piece 5 may be pulled by the movable body 6 to move the second contact 9 away from the first contact 8.

The movable body 6 includes a pivot 17 and a contact portion 18. The pivot 17 is rotatably supported on the base 2. The pivot 17 is located on a side where the support 12 is disposed with respect to the curved portion 16. The contact portion 18 is disposed at a position facing the contact piece 5. The movable body 6 rotates around the pivot 17 in a direction of approaching the contact piece 5 to bring the contact portion 18 into contact with the contact piece 5. The contact portion 18 thus presses the leading end portion 14 of the contact piece 5 to move the second contact 9 close to the first contact 8.

The movable body 6 includes a first movable portion 21 and a second movable portion 22. The first movable portion 21 and the second movable portion 22 are separate portions. The first movable portion 21 includes the pivot 17. The second movable portion 22 includes the contact portion 18, and extends from the first movable portion 21 toward the contact piece 5.

The first movable portion 21 includes a first part 23 and a second part 24. The first movable portion 21 has a shape bent at a position between the first part 23 and the second part 24. More specifically, the first part 23 obliquely extends from the pivot 17 toward the contact piece 5. The second part 24 is disposed between the contact piece 5 and the actuator 7.

The second movable portion 22 extends from a leading end of the first movable portion 21 toward the leading end portion 14 of the contact piece 5. The second movable portion 22 is connected to the leading end of the first movable portion 21. More specifically, as illustrated in FIG. 1, the second movable portion 22 includes an opening 25. The leading end of the first movable portion 21 is disposed inside the opening 25 of the second movable portion 22.

The second movable portion 22 includes a recess 26. The leading end portion 14 of the contact piece 5 is disposed inside the recess 26. The contact portion 18 described above is a part of an edge of the recess 26. The leading end portion 14 of the contact piece 5 has a shape bent toward the contact portion 18. When the first movable portion 21 rotates around the pivot 17 in a direction of approaching the contact piece 5, the second movable portion 22 is pressed by the leading end of the first movable portion 21. Accordingly, the second movable portion 22 linearly moves in such a direction that the contact portion 18 approaches the contact piece 5.

The actuator 7 presses the movable body 6 to rotate the movable body 6 around the pivot 17. The actuator 7 includes a coil 31, a retaining mechanism 32, and a pressing member 33. The coil 31 includes a bobbin 34, a winding 35, a coil case 36, and an iron core 37. The winding 35 is wound around the bobbin 34. The winding 35 is connected to a not-shown coil terminal. When voltage is applied to the coil 31 via the coil terminal, the coil 31 generates magnetic force which moves the iron core 37 disposed inside the coil 31 in an axial direction of the actuator 7.

The retaining mechanism 32 and the pressing member 33 are disposed inside a housing 39. The retaining mechanism 32 transmits an action of the iron core 37 to the pressing member 33 to move the pressing member 33 to an on-position illustrated in FIG. 2 or an off-position illustrated in FIG. 3. The retaining mechanism 32 also mechanically retains the pressing member 33 at the on-position or off-position in a state that no voltage is applied to the coil 31. The retaining mechanism 32 will be described in detail below.

The pressing member 33 moves in the axial direction to press the movable body 6. A pressing position P1 at which the pressing member 33 presses the movable body 6 is located between the pivot 17 and the contact portion 18. The pressing position P1 is located on a side where the second contact 9 is disposed with respect to the curved portion 16. The pressing position P1 is located on a side where the curved portion 16 is disposed with respect to the second contact 9.

At the off-position of the pressing member 33 as illustrated in FIG. 3, the first contact 8 and the second contact 9 are separated from each other and the relay 1 is in the reset state. When the pressing member 33 moves to the on-position illustrated in FIG. 2 and presses the movable body 6, the contact portion 18 presses the contact piece 5. The contact piece 5 therefore bends toward the movable contact terminal 4. As a result, the first contact 8 and the second contact 9 come into contact with each other, and the relay 1 is in the set state as illustrated in FIG. 2. When the pressing member 33 returns from the on-position to the off-position as illustrated in FIG. 3, the first contact 8 and the second contact 9 are separated from each other, and the relay 1 is returned into the reset state.

Figure 4:
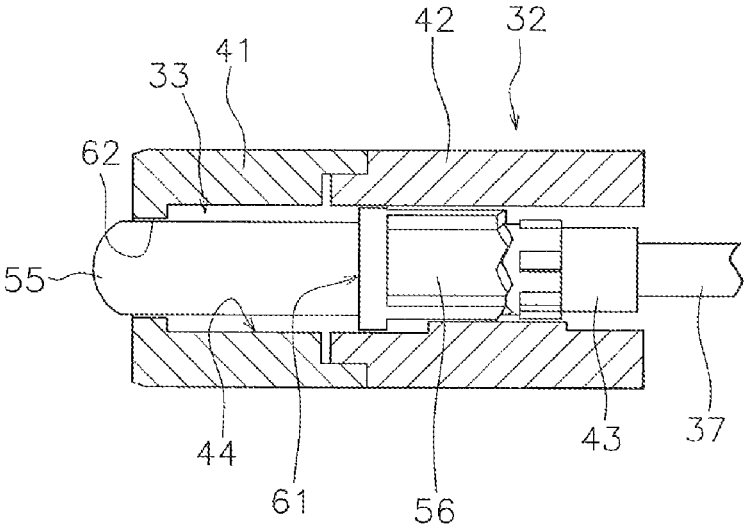
FIG. 4 is a cross-sectional view illustrating a configuration of a retaining mechanism.
Figure 5:
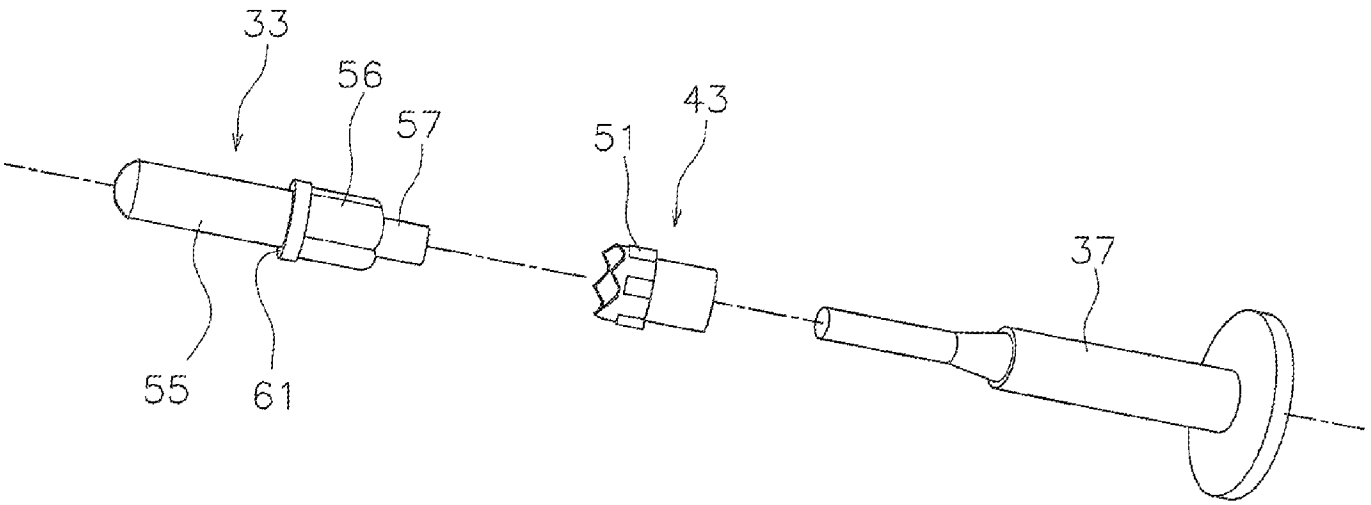
FIG. 5 is an exploded perspective view illustrating a part of the retaining mechanism.

Next, a configuration of the retaining mechanism 32 is described in detail. FIG. 4 is a cross-sectional view illustrating the configuration of the retaining mechanism 32. FIG. 5 is an exploded perspective view illustrating a part of the configuration of the retaining mechanism 32. As illustrated in FIG. 4, the retaining mechanism 32 includes a cover 41, a retaining member 42, and a pusher 43.

The cover 41 is attached to a leading end of the retaining member 42. A through hole 44 is formed inside the cover 41 and the retaining member 42. The pressing member 33, the pusher 43, and the iron core 37 described above are disposed to be movable in the axial direction within the through hole 44.

Figure 6:
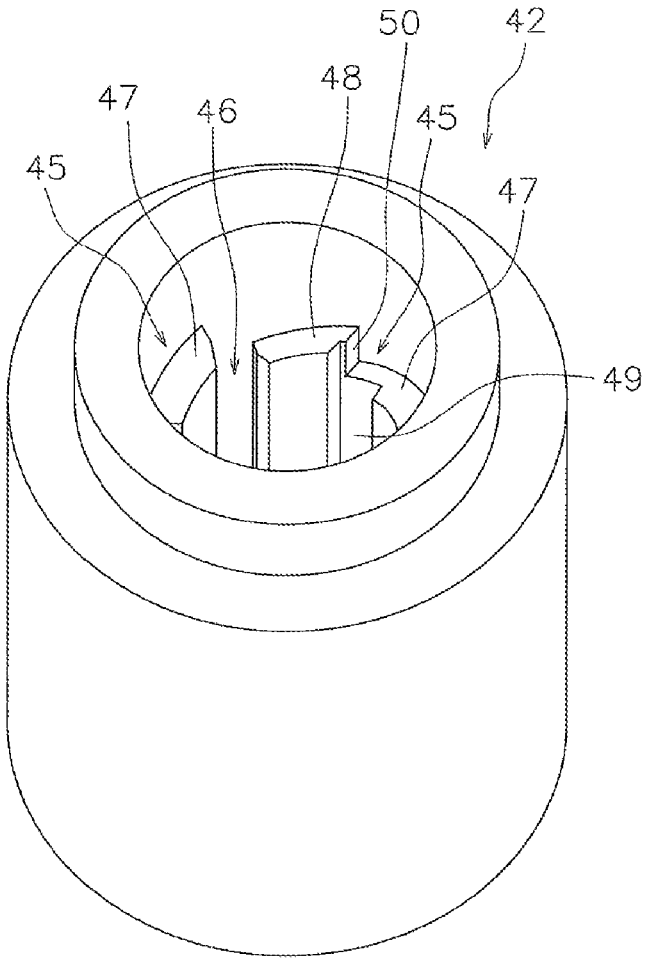
FIG. 6 is a perspective view of a retaining member.
Figure 7:
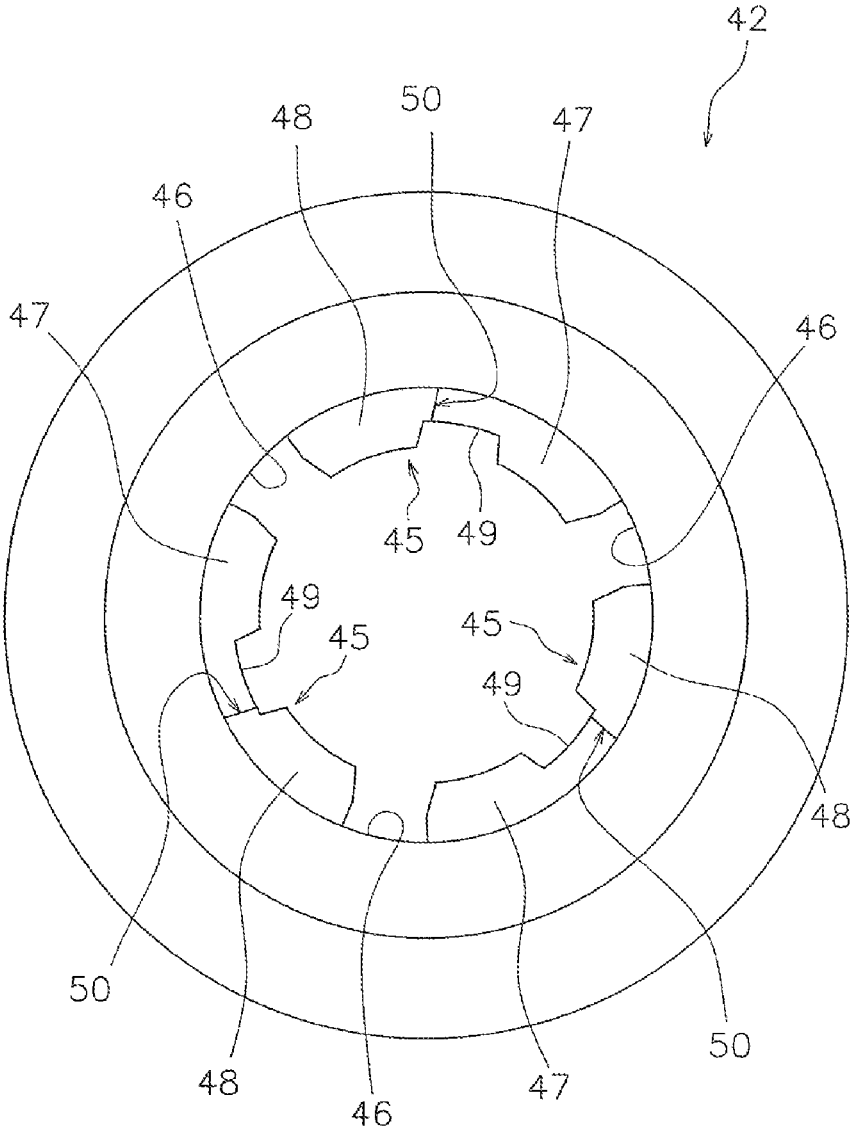
FIG. 7 is a view of the retaining member as viewed in an axial direction.

FIG. 6 is a perspective view of the retaining member 42. FIG. 7 is a view of the retaining member 42 as viewed in the axial direction. As illustrated in FIGS. 6 and 7, the retaining member 42 includes a plurality of retaining projections 45. The retaining projections 45 project from an inner circumferential surface of the retaining member 42. The plurality of retaining projections 45 are disposed with a space left between each other in the circumferential direction of the retaining member 42. A release groove 46 extending in the axial direction is formed in each of the spaces between the plurality of retaining projections 45.

Figure 8:
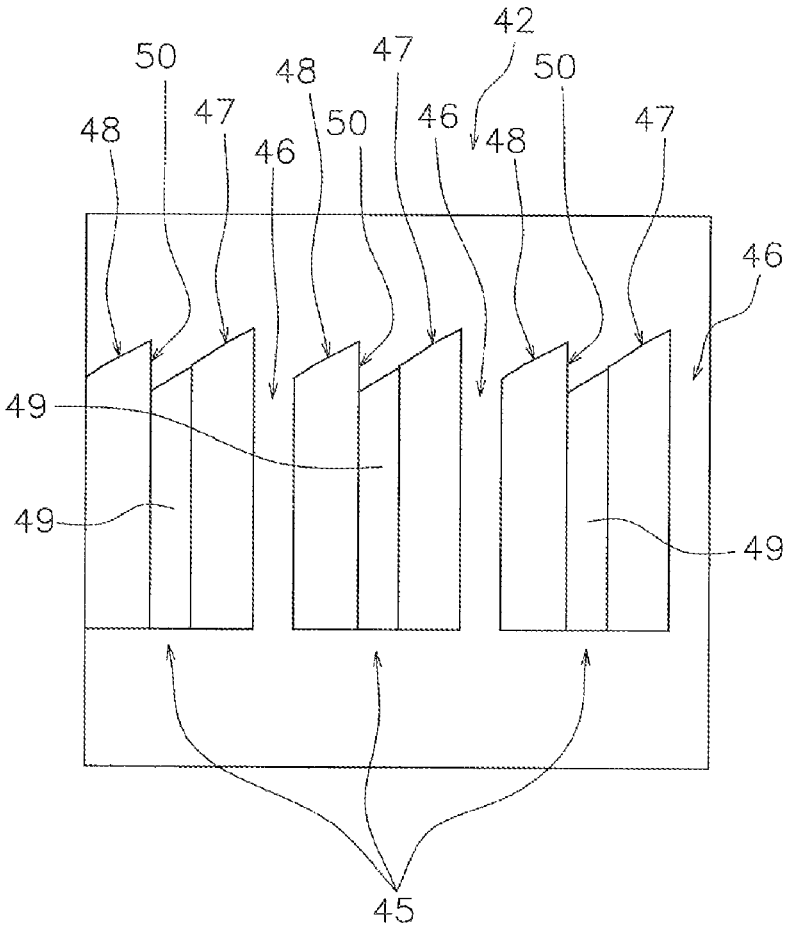
FIG. 8 is a developed view of an inner surface of the retaining member.

FIG. 8 is a view of the inner circumferential surface of the retaining member 42 developed in a plane. As illustrated in FIGS. 7 and 8, each of the retaining projections 45 has a latching inclined surface 47 and a releasing inclined surface 48. A step is formed by the latching inclined surface 47 and the releasing inclined surface 48. Each of the retaining projections 45 includes a guide groove 49 extending in the axial direction.

Figure 9:
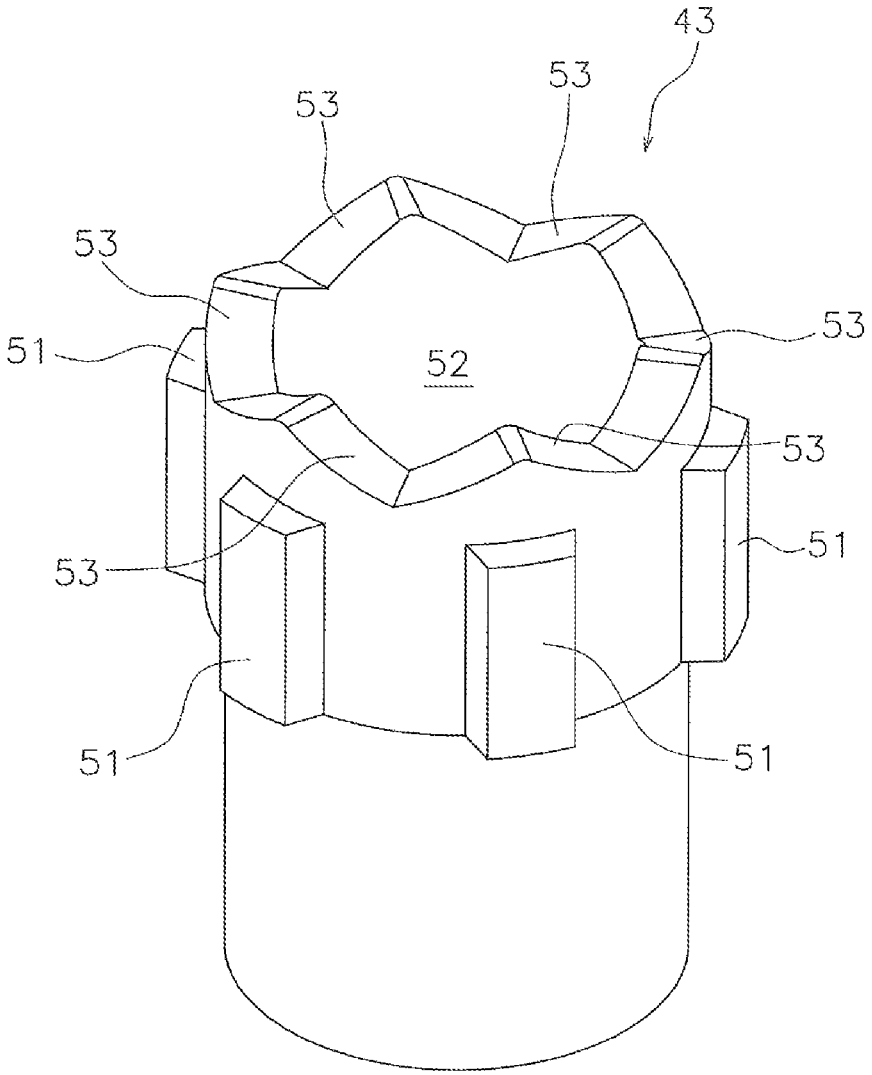
FIG. 9 is a perspective view of a pusher.

FIG. 9 is a perspective view of the pusher 43. As illustrated in FIG. 9, a plurality of guide projections 51 are formed on an outer circumferential surface of the pusher 43. The guide projections 51 are disposed with a space left between each other in the circumferential direction of the pusher 43. Each of the guide projections 51 is disposed in the guide groove 49 and the release groove 46 of the retaining member 42. When the pusher 43 moves in the axial direction, the guide projections 51 move along the guide grooves 49 and the release grooves 46. A bore 52 and a plurality of inclined surfaces 53 are provided at one end of the pusher 43. The plurality of inclined surfaces 53 are disposed around the bore 52. The one end of the pusher 43 is allowed to be pressed by the iron core 37.

Figure 10:
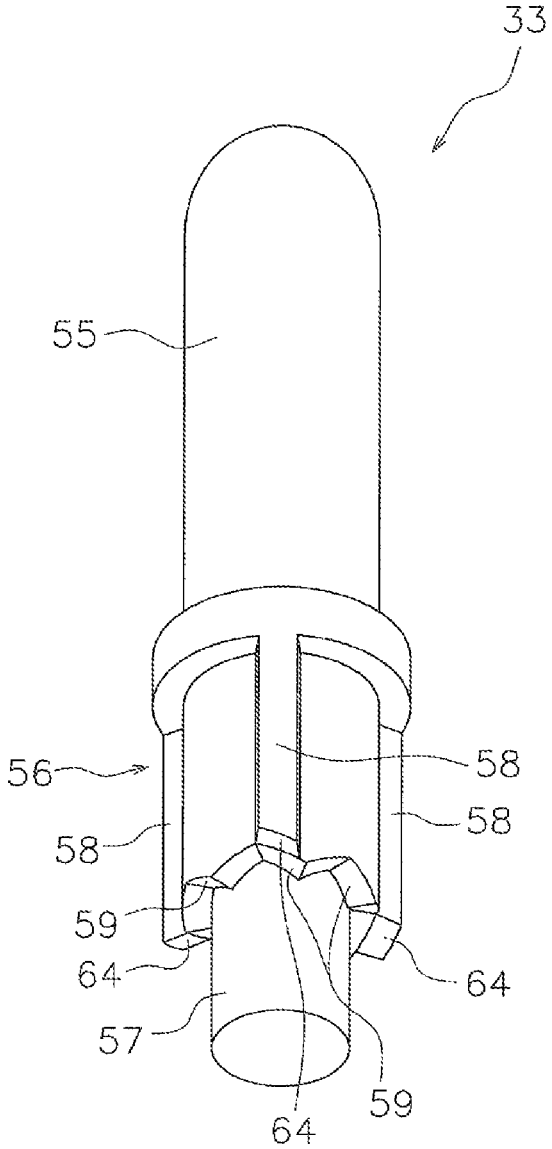
FIG. 10 is a perspective view of a pressing member.

FIG. 10 is a perspective view of the pressing member 33. As illustrated in FIG. 10, the pressing member 33 includes a pressing portion 55, a latching portion 56, and a support shaft 57. The pressing portion 55 has a shaft shape. A leading end of the pressing portion 55 has a curved shape. The leading end of the pressing portion 55 comes into contact with the movable body 6 when the pressing member 33 presses the movable body 6.

The latching portion 56 has a plurality of latching projections 58. The plurality of latching projections 58 are disposed with a space left between each other in the circumferential direction of the latching portion 56. The plurality of latching projections 58 are movable along the release grooves 46 described above.

Figure 11:
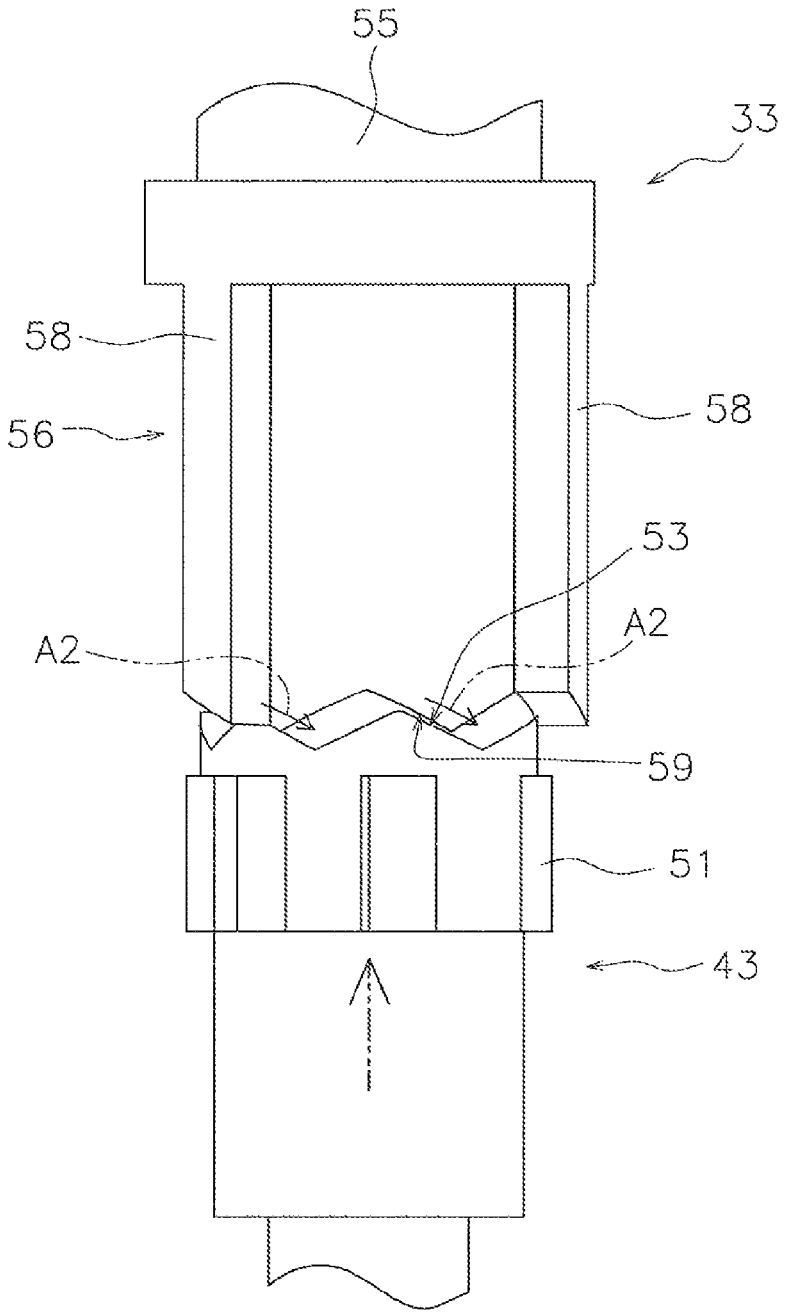
FIG. 11 is an enlarged view illustrating the pressing member and the pusher.

A plurality of inclined surfaces 59 are provided at an end of the latching portion 56. The plurality of inclined surfaces 59 are disposed in the circumferential direction of the latching portion 56. FIG. 11 is a view illustrating the pressing member 33 and the pusher 43. As illustrated in FIG. 11, the plurality of inclined surfaces 59 of the latching portion 56 are disposed at positions facing the plurality of inclined surfaces 53 of the pusher 43. As illustrated in FIG. 10, the support shaft 57 projects from the latching portion 56. The support shaft 57 is disposed in the bore 52 of the pusher 43. Accordingly, the pressing member 33 is supported by the pusher 43 in such a manner as to be movable in the axial direction and rotatable around the axis.

As illustrated in FIGS. 4 and 5, a step 61 is formed by the pressing portion 55 and the latching portion 56. A flange 62 is provided on the inner circumferential surface of the cover 41.

Figure 12:
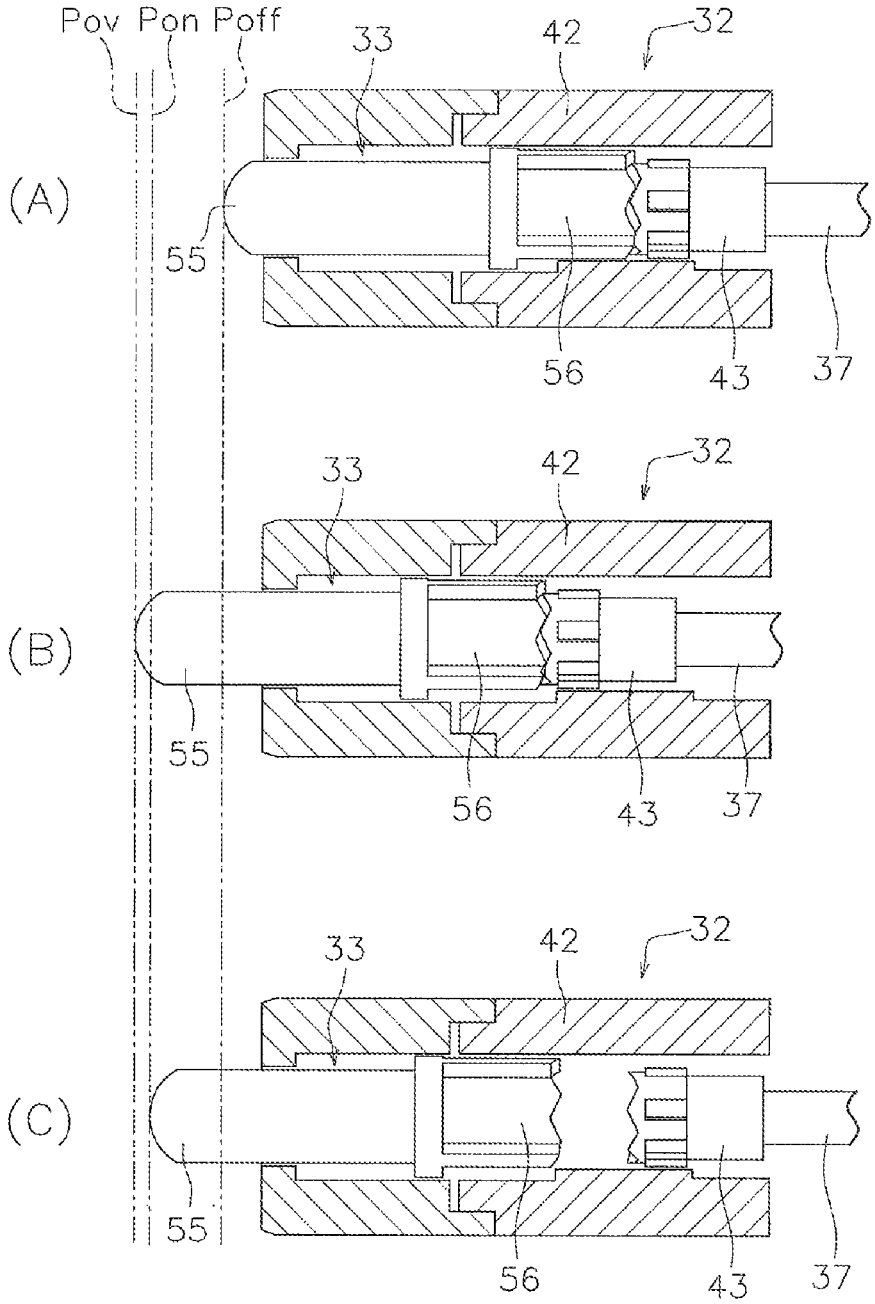
FIG. 12 is a cross-sectional view illustrating operation states of an actuator.

Next, an operation of the actuator 7 is described. FIG. 12 is a cross-sectional view illustrating operation states of the actuator 7. In FIG. 12, the on-position and the off-position of the pressing member 33 are expressed as "Pon" and "Poff", respectively. Further, an overshoot position of the pressing member 33 described below is expressed as "Pov". Each of FIGS. 13(A) to 13(C) and FIGS. 14(A) to 14(C) illustrates a relationship between the inner circumferential surface of the retaining member 42 and the latching projections 58 of the pressing member 33 in a plane.

In the following description, an "off-direction" refers to a direction from the on-position Pon to the off-position Poff. The "off-direction" corresponds to the right direction in FIG. 12, and to the downward direction in FIGS. 13(A) to 13(C) and FIGS. 14(A) to 14(C). An "on-direction" refers to a direction from the off-position Poff to the on-position Pon. The "on-direction" corresponds to the left direction in FIG. 12, and to the upward direction in FIGS. 13(A) to 13(C) and FIGS. 14(A) to 14(C).

Figure 13:
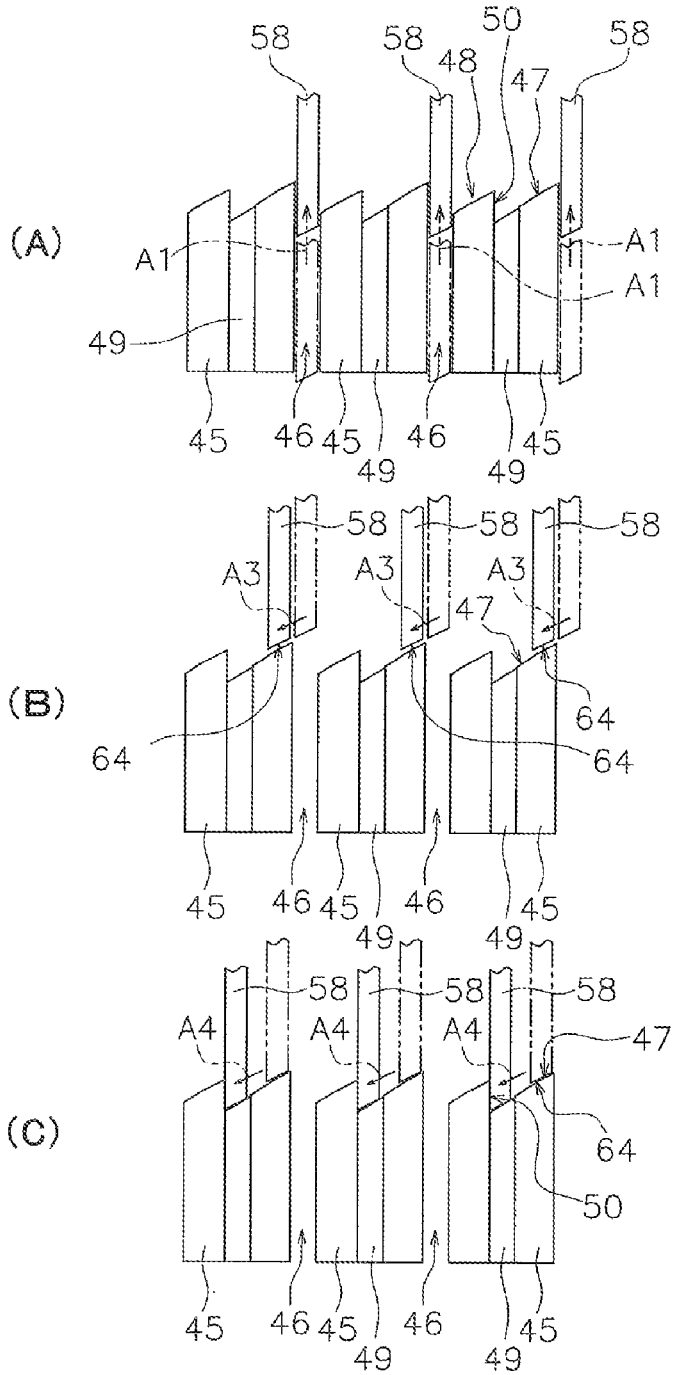
FIGS. 13(A), 13(B), and 13(C) are developed views illustrating operations of an inner circumferential surface of the retaining member and latching projections of a latching member.

In (A) of FIG. 12, the pressing member 33 is located at the off-position Poff. In this state, the latching projections 58 of the pressing member 33 are disposed inside the release grooves 46 of the retaining member 42 as indicated by two-dot chain lines in FIG. 13(A). When voltage is applied to the actuator 7, the coil 31 generates electromagnetic force in the iron core 37 in the on-direction. As a result, the iron core 37 moves in the on-direction and presses the pusher 43. The pusher 43 presses the latching portion 56 in the on-direction. Accordingly, the latching projections 58 move in the on-direction along the release grooves 46 (arrows A1) as illustrated in FIG. 13(A).

At this time, the inclined surfaces 53 of the pusher 43 press the inclined surfaces 59 of the latching portion 56 as illustrated in FIG. 11. The latching portion 56 therefore receives force for rotating the latching portion 56 (arrows A2). Accordingly, when the latching projections 58 reach positions above the retaining projections 45, the latching projections 58 move to positions facing the latching inclined surfaces 47 in accordance with rotation of the latching portion 56 (arrows A3) as illustrated in FIG. 13(B).

In the state that the latching projections 58 are located above the retaining projections 45, the pressing member 33 is further moved in the on-direction from the on-position Pon and reaches the overshoot position Pov as illustrated in (B) of FIG. 12.

When voltage applied to the actuator 7 stops, the pressing member 33 moves in the off-direction by the elastic force of the contact piece 5. Accordingly, the latching projections 58 move in the off-direction and contact the latching inclined surfaces 47 as illustrated in FIG. 13(C). Each end of the latching projections 58 has an inclined surface 64 inclined in the same direction as the inclination direction of the latching inclined surfaces 47. The latching portion 56 is therefore pressed further in the off-direction, so that the respective inclined surfaces 64 of the latching projections 58 slide along the latching inclined surfaces 47 (arrows A4). Thereafter, the latching projections 58 come to a stop when latched by the latching inclined surfaces 47 and the steps 50.

In this state, the pressing member 33 is located at the on-position Pon illustrated in (C) of FIG. 12. In the latched state of the latching portion 56 by the retaining member 42, the pressing member 33 does not move in the off-direction even when the pusher 43 and the iron core 37 return in the off-direction as illustrated in (C) of FIG. 12. Accordingly, the pressing member 33 is retained at the on-position Pon while resisting the elastic force of the contact piece 5.

Each of the latching projections 58 moving to a position facing the guide groove 49 has a larger outside diameter than the inside diameter of the guide groove 49. Thus, each of the latching projections 58 does not enter the guide groove 49, but stops by latching of the retaining projection 45. This latching regulates the movement of the latching projection 58 in the off-direction.

When voltage is subsequently applied to the actuator 7 in the state that the pressing member 33 is located at the on-position Pon as illustrated in (C) of FIG. 12, the coil 31 generates electromagnetic force in the iron core 37 in the on-direction. Thus, the iron core 37 moves in the on-direction, and the pusher 43 presses the pressing member 33 in the on-direction from the on-position Pon while resisting the elastic force of the contact piece 5. As a result, the latching projections 58 move in the on-direction (arrows A5) as illustrated in FIG. 14(A).

Figure 14:
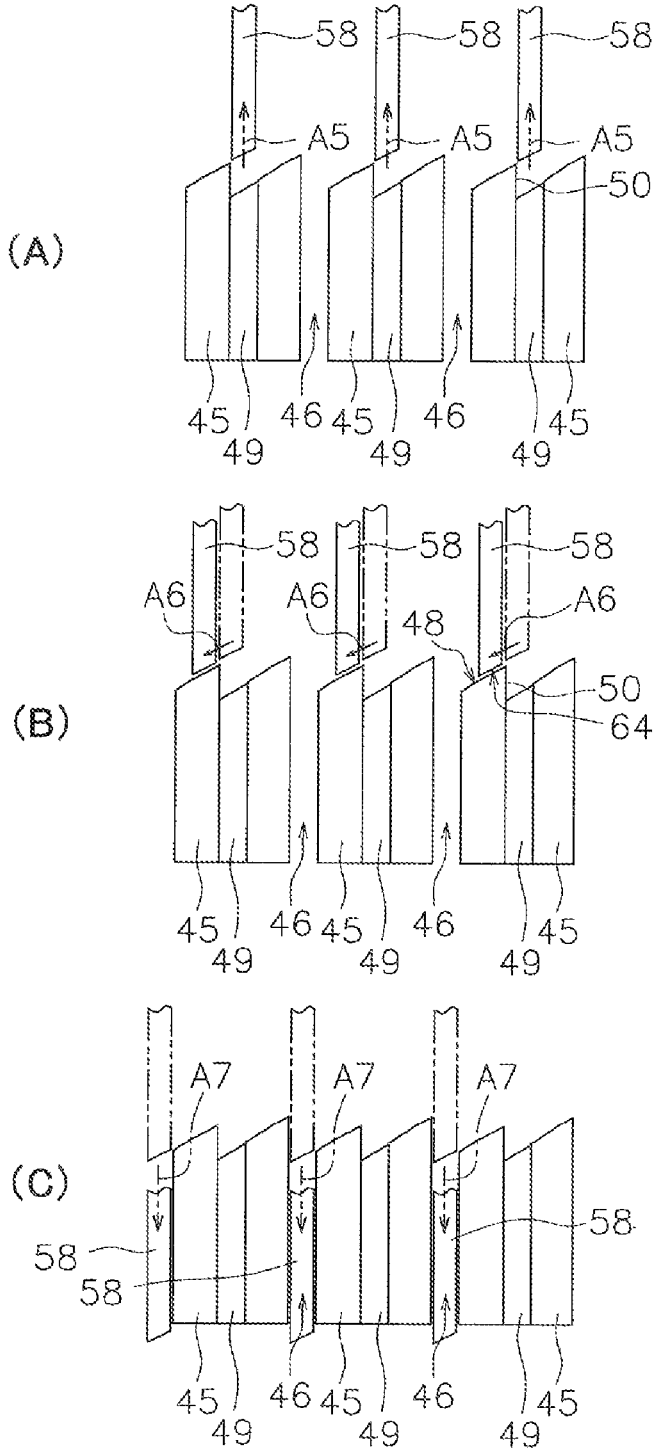
FIGS. 14(A), 14(B), and 14(C) are developed views illustrating operations of the inner circumferential surface of the retaining member and the latching projections of the latching member.

When the latching projections 58 reach positions above the steps 50 of the retaining member 42, the latching portion 56 rotates around the axis in the same manner as described above. As a result, the latching projections 58 move to positions facing the releasing inclined surfaces 48 (arrows A6) as illustrated in FIG. 14 (B). At this time, the pressing member 33 is located at the overshoot position Pov illustrated in (C) of FIG. 12.

When voltage applied to the actuator 7 then stops, the pressing member 33 moves in the off-direction by the elastic force of the contact piece 5. The inclined surfaces 53 of the latching projections 58 therefore slide along the releasing inclined surfaces 48, and move to positions facing the release grooves 46 as illustrated in FIG. 14(C). Subsequently, the latching projections 58 move in the off-direction along the release grooves 46. Accordingly, the latching portion 56 moves in the off-direction, whereby the pressing member 33 returns to the off-position Poff.

The relay 1 according to the embodiment has the following characteristics.

In the relay 1 according to the embodiment, a distance L1 between the pivot 17 and the contact portion 18 can be reliably made long as illustrated in FIG. 2. In addition, the actuator 7 presses the pressing position P1 provided between the pivot 17 and the contact portion 18. Accordingly, the second contact 9 is largely movable with a small stroke of the actuator 7. Moreover, a distance L2 between the pressing position P1 and the pivot 17 can be reliably made long. Thus, the second contact 9 is movable by small pressing force produced by the actuator 7. Accordingly, power consumption by the actuator 7 can be reduced.

The pressing member 33 is retained at the on-position Pon by latching of the latching portion 56 by the retaining member 42. In other words, the pressing member 33 is retained at the on-position Pon not by magnetic force but in a mechanical manner. Accordingly, the relay 1 can be maintained in the set state even at a stop of voltage applied to the coil 31. Moreover, when voltage is applied to the coil 31 to cancel the set state, the pusher 43 rotates and retains the pressing member 33 at the off-position Poff. Accordingly, the relay 1 can be maintained in the reset state even at a stop of voltage applied to the coil 31.

In the relay 1 according to the embodiment, the state of the relay 1 switches between the set state and the reset state for every input of a pulse signal to the actuator 7. If no signal is input, the state of the relay 1 is maintained without change in the state. In this case, the state of the relay 1 can be maintained without the need of continuous application of voltage to the actuator 7. Accordingly, power consumption of the relay 1 can be reduced. Moreover, control by the pulse signal as adopted herein can simplify the configuration of a control circuit included in the actuator 7.

Because the relay 1 is maintained in the set state by the latching between the retaining member 42 and the latching portion 56, impact resistance can be improved as compared to the case that the relay 1 is maintained in the set state by electromagnetic force generated by the coil 31. Furthermore, the set state can be continued without being affected by magnetism from the outside.

The movable body 6 has a bent shape. Accordingly, the movable body 6, the actuator 7, and the contact piece 5 can be disposed in a compact manner even when the distance L1 between the pivot 17 and the contact portion 18 increases in accordance with elongation of the movable body 6.

The leading end portion 14 of the contact piece 5 has a shape bent toward the contact portion 18. This shape increases contact pressure between the contact portion 18 and the contact piece 5, thereby stabilizing and maintaining the contact between the contact portion 18 and the contact piece 5.

The leading end of the pressing member 33 has a curved shape. This shape reduces abrasion produced by friction between the leading end of the pressing member 33 and the movable body 6.

The present invention is not limited to the embodiment described herein as a specific embodiment of the present invention. Various modifications may be made without departing from the scope of the subject matters of the invention.

The configuration of the relay 1 may be modified. For example, not a single but two or more contacts may be provided to constitute each of the first contact 8 and the second contact 9. The configuration of the contact piece 5 may be modified from the configuration described above in the embodiment.

Figure 15:
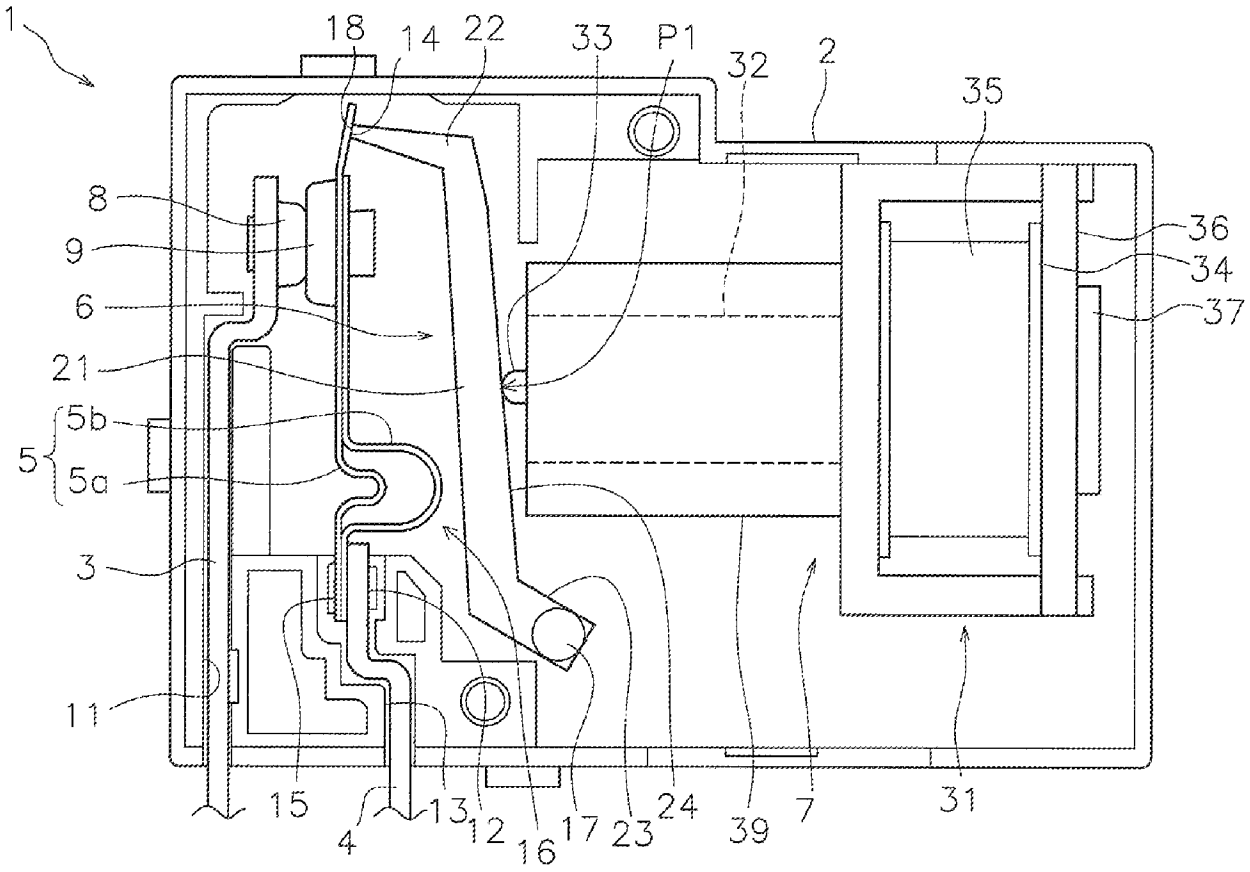
FIG. 15 is a plan view illustrating a relay according to a modified example.
Figure 16:
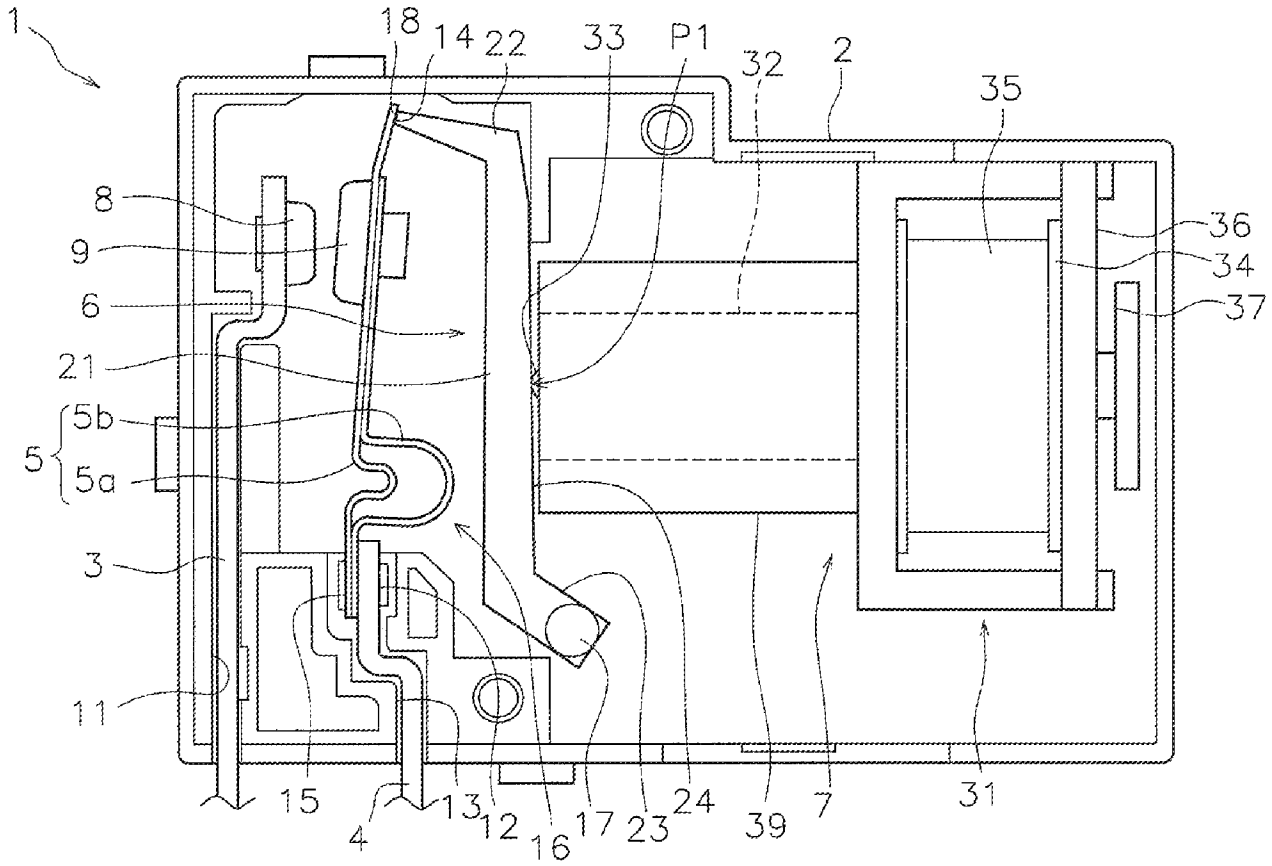
FIG. 16 is a plan view illustrating the relay according to the modified example.

The shape of the movable body 6 may be modified from the shape described above in the embodiment. For example, FIGS. 15 and 16 are plan views each illustrating the relay 1 according to a modified example. FIG. 15 illustrates the relay 1 in the set state according to the modified example. FIG. 16 illustrates the relay 1 in the reset state according to the modified example.

As illustrated in FIGS. 15 and 16, the first movable portion 21 and the second movable portion 22 may be integrated into one piece. In other words, the movable body 6 may have a shape bent at a position between the first movable portion 21 and the second movable portion 22. In this case, the second movable portion 22 rotates together with the first movable portion 21. The second movable portion 22 therefore moves to be close to the second contact 9 at the time of switching of the relay 1 from the reset state to the set state. Accordingly, the second movable portion 22 can press the contact piece 5 in such a manner as to immobilize the second contact 9, thereby increasing stability of contact between the first contact 8 and the second contact 9.

The configuration of the actuator 7 may be modified from the configuration described above in the embodiment. Similarly, the configuration of the retaining mechanism 32 may be modified.

Figure 17:
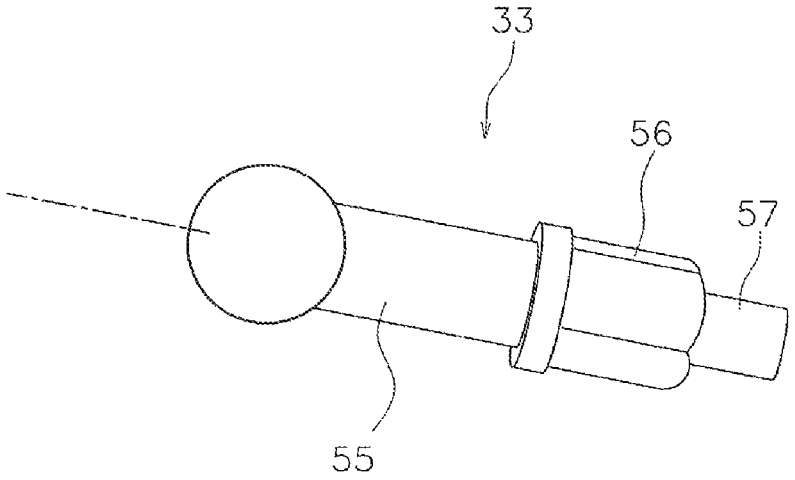
FIG. 17 is a view illustrating a pressing member according to a modified example.

The shape of the pressing member 33 may be modified from the shape described above in the embodiment. For example, FIG. 17 is a view illustrating the pressing member 33 according to a modified example. As illustrated in FIG. 17, the leading end of the pressing member 33 may have a spherical shape. This shape reduces abrasion of the leading end of the pressing member 33 even when friction is produced between the pressing member 33 and the movable body 6 by rotation of the pressing member 33 around the axis as described above.

INDUSTRIAL APPLICABILITY

According to the present invention, a relay which includes contacts operable with small force to reduce energy consumed by an actuator can be provided.

DESCRIPTION OF SYMBOLS

8 first contact
9 second contact
5 contact piece
12 support
6 movable body
7 actuator
16 curved portion
21 first movable portion
22 second movable portion
33 pressing member
42 retaining member

The invention claimed is:

1. A relay comprising:
a first contact;
a second contact disposed at a position facing the first contact;
a contact piece to which the second contact is attached;
a support configured to support the contact piece;
a movable body that includes a pivot rotatably supported and a contact portion disposed at a position contactable with the contact piece, the movable body configured to rotate around the pivot and press the contact piece via the contact portion to move the second contact close to the first contact; and
an actuator configured to press the movable body to rotate the movable body around the pivot, wherein
the contact piece includes a curved portion located between the second contact and the support,
the pivot is located on a side where the support is disposed with respect to the curved portion,
the actuator includes a pressing member configured to press the movable body, and
the pressing member moves in a direction of an axis of the pressing member to press the movable body.

2. The relay according to claim 1, wherein a pressing position at which the pressing member presses the movable body is located between the pivot and the contact portion.

3. The relay according to claim 2, wherein the pressing position is located on a side where the second contact is disposed with respect to the curved portion.

4. The relay according to claim 2, wherein the pressing position is located on a side where the curved portion is disposed with respect to the second contact.

5. The relay according to claim 1, wherein the movable body has a bent shape.

6. The relay according to claim 1, wherein the movable body includes a first movable portion that includes the pivot, and extends in a lengthwise direction of the contact piece, and a second movable portion that includes the contact portion, and extends from the first movable portion toward the contact piece.

7. The relay according to claim 6, wherein the first movable portion and the second movable portion are separate portions.

8. The relay according to claim 6, wherein the first movable portion and the second movable portion are integrated into one piece.

9. The relay according to claim 8, wherein a leading end portion of the contact piece has a shape bent toward the contact portion.

10. The relay according to claim 1, wherein a leading end of the pressing member has a curved shape.

11. The relay according to claim 1, wherein the pressing member is configured to move in the direction of the axis of the pressing member, and rotate around the axis, and a leading end of the pressing member has a spherical shape.

12. The relay according to claim 1, wherein the pressing member is configured to move to an off-position where the first contact and the second contact are not in contact with each other, and an on-position where the first contact and the second contact are in contact with each other, and the actuator further includes a retaining member that latches the pressing member to retain the pressing member at the on-position.

* * * * *